US008443507B2

(12) United States Patent
Cho

(10) Patent No.: US 8,443,507 B2
(45) Date of Patent: May 21, 2013

(54) METHOD FOR FORMING A REINFORCED TOOLBOX

(76) Inventor: Yao-Lin Cho, Taichung County (TW)

( * ) Notice: Subject to any disclaimer, the term of this patent is extended or adjusted under 35 U.S.C. 154(b) by 175 days.

(21) Appl. No.: 13/010,726

(22) Filed: Jan. 20, 2011

(65) Prior Publication Data

US 2011/0113615 A1 May 19, 2011

Related U.S. Application Data

(63) Continuation-in-part of application No. 12/539,619, filed on Aug. 12, 2009, now abandoned.

(51) Int. Cl.
*B21D 39/00* (2006.01)
*B25H 3/02* (2006.01)

(52) U.S. Cl.
USPC ..... 29/525.01; 29/527.1; 206/349

(58) Field of Classification Search
USPC ..... 29/525.01, 525.02, 527.1; 206/349, 206/436, 487, 372, 373, 586, 453, 459.5, 206/320; 190/100, 127, 37, 25; 220/212
See application file for complete search history.

(56) References Cited

U.S. PATENT DOCUMENTS

| | | | | |
|---|---|---|---|---|
| 4,615,464 | A * | 10/1986 | Byrns | 220/4.23 |
| 2001/0038010 | A1* | 11/2001 | Chien | 220/4.01 |
| 2002/0104709 | A1* | 8/2002 | Hines | 182/129 |
| 2006/0201833 | A1* | 9/2006 | Chen | 206/349 |

* cited by examiner

*Primary Examiner* — Jermie Cozart

(57) ABSTRACT

A method for forming a reinforced toolbox includes the step of: injection molding step: injection molding a toolbox with plastic material; extruding step: extruding a protector strip with aluminum; cutting step: cutting the protector strip into a plurality of protectors; assembling step: assembling the protector with the toolbox.

2 Claims, 6 Drawing Sheets

METHOD FOR FORMING A REINFORCED TOOLBOX

CROSS-REFERENCE TO RELATED APPLICATION

This application is a Continuation-In-Part application of Ser. No. 12/539,619, filed 12 Aug. 2009, now abandoned and entitled "TOOLBOX WITH REINFORCING STRUCTURE".

BACKGROUND OF THE INVENTION

1. Field of the Invention

The present invention relates to a method for forming a toolbox, and more particularly to form a toolbox reinforced by a plurality of protection members which are moulded by extruded aluminium.

2. Description of Related Art

A conventional toolbox with reinforcing structure comprises a box, a bottom for the box having a first flange disposed parallel to the side wall of the box. An angle member is disposed in the box. The angle member has a second flange engaged between the first flanges of the bottom and the side wall of the box. The side wall has a third flange disposed below the bottom and approximately parallel to the bottom. A bar is transversely inserted between the third flange and the bottom to reinforce the bottom and to reinforce the third flange. A band surrounds the box. A plurality of securing elements is extended through the band and through the wall of the box, wherein the band reinforces the side walls of the box.

However, the prior art is suffered from several disadvantages. The toolbox only has the band surrounding the side wall and the bar engaged with the flanges disposed on side walls and the bottom for reinforcing the bottom and the side walls. A reinforce structure of the conventional toolbox is not strong enough such that the box may be fractured or broken on edges or surfaces easily. In addition, the box does not have any element provided for reinforcing corners thereof. Therefore, the toolbox does not have enough structural strength to carry the weight of heavy tools and to prevent from breaking.

The present invention has arisen to mitigate and/or obviate the disadvantages of the conventional toolbox with reinforcing structure.

SUMMARY OF THE INVENTION

The main objective of the present invention is to provide an improved method for forming a reinforced toolbox.

To achieve the objective, the method for forming a reinforced toolbox in accordance with the present invention includes the steps of:

injection molding step: injection molding a toolbox with plastic material, each edge of the toolbox having a groove formingly defined therein, one end of the groove extending through one end of the edge of the toolbox to form an opening, an inner periphery of the groove being gradually tapered from a bottom thereof to form a dove-tail structure;

extruding step: extruding a protector strip with aluminum, the protector strip having a longitudinal rib formed on one side thereof and extending along a length thereof, the longitudinal rib having a shape correspondingly fitting to the groove in the toolbox;

cutting step: cutting the protector strip into a plurality of protectors, each protector having a length corresponding to that of the groove in the toolbox; and assembling step: sliding the longitudinal rib of each protector from the opening into the corresponding groove for protecting the edges of the toolbox such that a reinforced toolbox is manufactured.

In accordance with a second aspect of the present invention, the second embodiment of the method for forming a reinforced toolbox comprising the step of:

injection molding step: injection molding a toolbox with plastic material, each surface of the toolbox having at least one recess formingly defined therein;

extruding step: extruding a prototypical plate with aluminum, the prototypical plate having at least one protrusion formed on one side thereof, each of the at least one protrusion having a shape correspondingly fitting to the recess in the toolbox;

cutting step: cutting the prototypical plate into a plurality of panel plate, each having a size corresponding to that of the surface of the toolbox; and assembling step: pressing the at least one protrusion of the panel plate into the at least one recess of the corresponding surface of the toolbox for protecting the surface of the toolbox such that a reinforced toolbox is manufactured.

Further benefits and advantages of the present invention will become apparent after a careful reading of the detailed description with appropriate reference to the accompanying drawings.

DETAILED DESCRIPTION OF THE INVENTION

Figure 1:
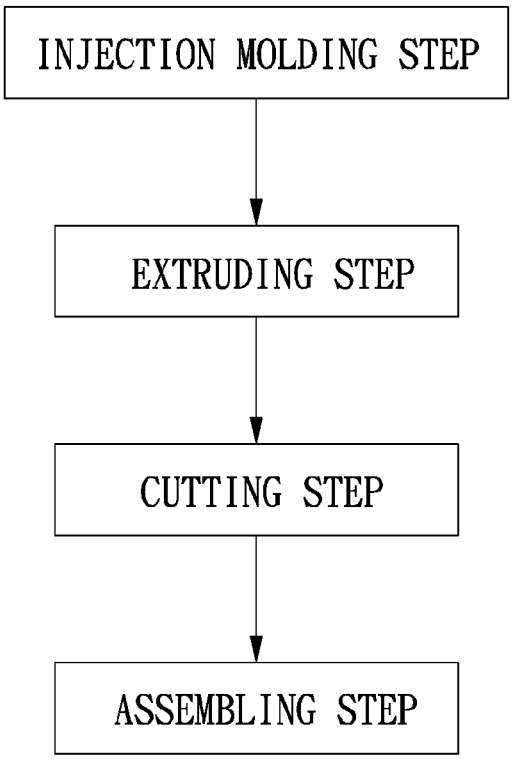
FIG. 1 is a flow chart of a method for forming a reinforced toolbox in accordance with the present invention.
Figure 2:
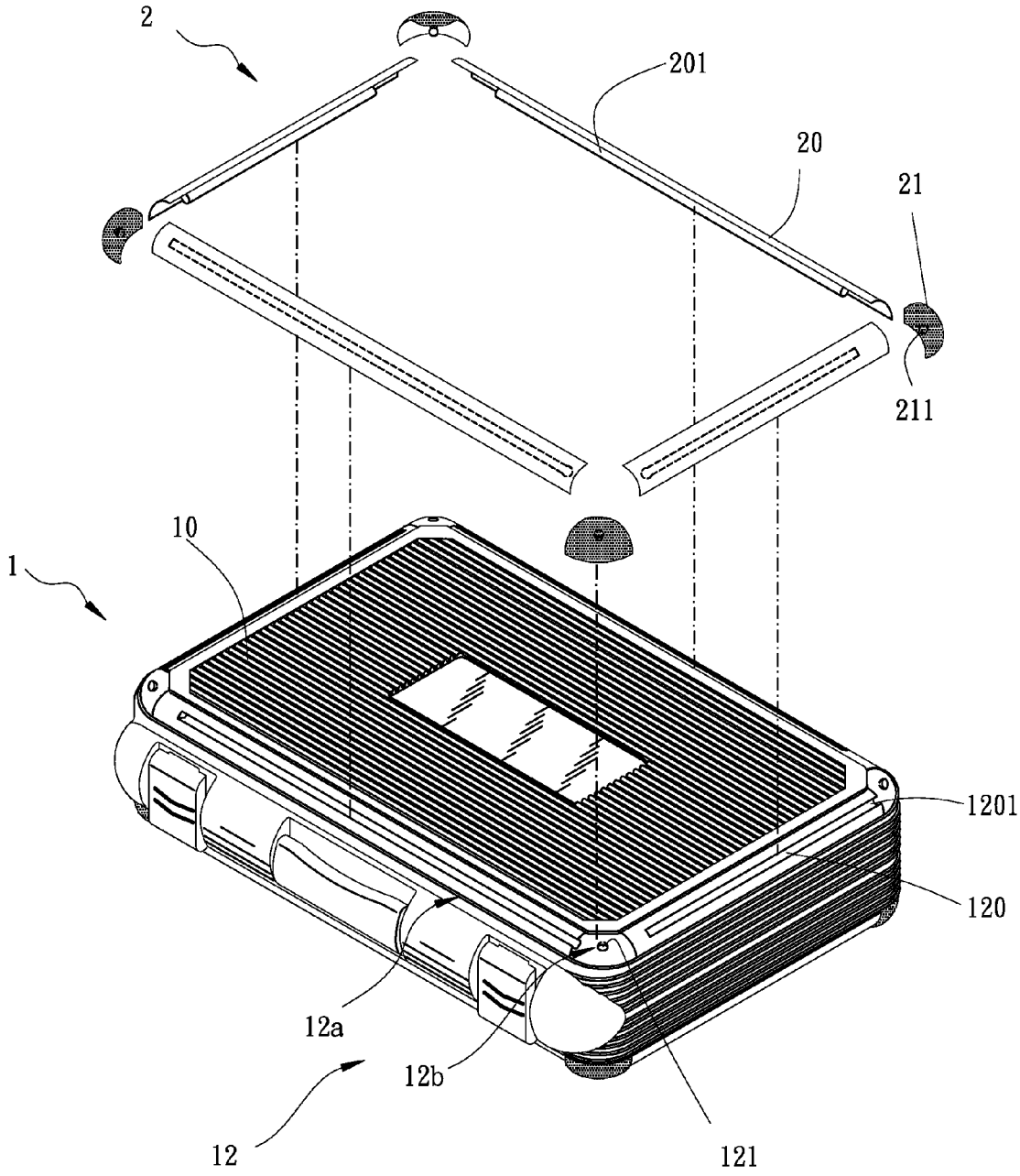
FIG. 2 is an exploded perspective view of a structure of a preferred embodiment of the reinforced toolbox.

Referring to the drawings and initially to FIGS. 1-10, a method for forming a reinforced toolbox in accordance with a first preferred embodiment of the present invention comprises the step of:

injection molding step: injection molding a toolbox (1) with plastic material, each edge of the toolbox (1) having a groove (120) formingly defined therein, one end of the groove (120) extending through one end of the edge of the toolbox (1) to form an opening (1201), an inner periphery of the groove (120) being gradually tapered from a bottom thereof to form a dove-tail structure.

extruding step: extruding a protector strip with aluminum, the protector strip having a longitudinal rib (201) formed on one side thereof and extending along a length thereof, the longitudinal rib (201) having a shape correspondingly fitting to the groove (120) in the toolbox (1);

cutting step: cutting the protector strip into a plurality of protectors (20), each protector (20) having a length corresponding to that of the groove (120) in the toolbox (1); and assembling step: sliding the longitudinal rib (201) of each protector (20) from the opening (1201) into the corresponding groove (120) for protecting the edges of the toolbox (1) such that a reinforced toolbox (1) is manufactured.

The method for forming a reinforced toolbox in accordance with a second preferred embodiment of the present invention comprises the step of:

injection molding step: injection molding a toolbox (1) with plastic material, each surface of the toolbox (1) having at least one recess (122) formingly defined therein;

extruding step: extruding a prototypical plate with aluminum, the prototypical plate having at least one protrusion (221) formed on one side thereof, each of the at least one protrusion (221) having a shape correspondingly fitting to the recess (122) in the toolbox (1);

cutting step: cutting the prototypical plate into a plurality of panel plate (22), each panel plate (22) having a size corresponding to that of the surface of the toolbox (1); and assembling step: pressing the at least one protrusion (221) of the panel plate (22) into the at least one recess (122) of the corresponding surface of the toolbox (1) for protecting the surface of the toolbox (1) such that a reinforced toolbox (1) is manufactured.

The benefit of the present invention is to provide a simple process for manufacturing a toolbox. The toolbox is reinforced due to the protectors and the panel plates. The protectors and the panel plates also provide decorating effect. Moreover, the protectors and panel plate are moulded by extruded aluminium, such that they are tailorable for adapting to suit different standards of toolboxes. Accordingly, the method provides for decorating and reinforcing the toolboxes and for lowering a productive cost. The assembly of the toolbox is easy and time saving.

For specifically describing the detailed structure of the reinforced toolbox, structure of the reinforced toolbox is described as the following:

Referring to FIGS. 2-10, A toolbox (1) has at least one connecting section (12) disposed thereon and at least one protection member (2) mounted on the at least one connecting section (12).

The at least one connecting section (12) includes four first connecting sections (12*a*) respectively disposed on four edges of an outer surface (10) of the toolbox (1). Each of the four first connecting sections (12*a*) has a groove (120) defined therein and parallel to the edge. One end of the groove (120) extends through one end of the edge to form an opening (1201). An inner periphery of the groove (120) is gradually tapered from a bottom thereof, such that the groove (120) has a dove-tail structure. The at least one connecting section (12) includes four second connecting sections (12*b*) respectively disposed on four corners of the outer surface (10) of the toolbox (1). Each of the four second connecting sections (12*b*) has a hole (121) defined in the centre thereof. The four first connecting sections (12*a*) are in a convexly arc shape. Each of the four second connecting sections (12*b*) uncovers the opening (1201) of the groove (120) on each of the four first connecting sections (12*a*).

Figure 3:
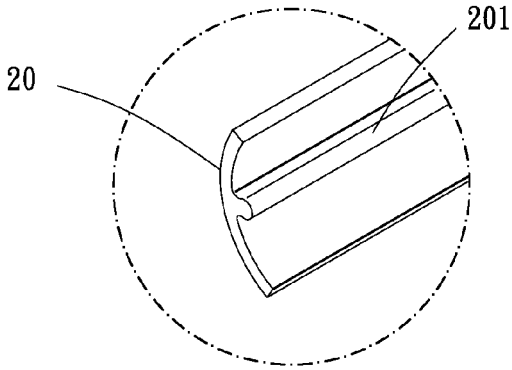
FIG. 3 is a partial perspective view of an edge protector of the reinforced toolbox.
Figure 4:
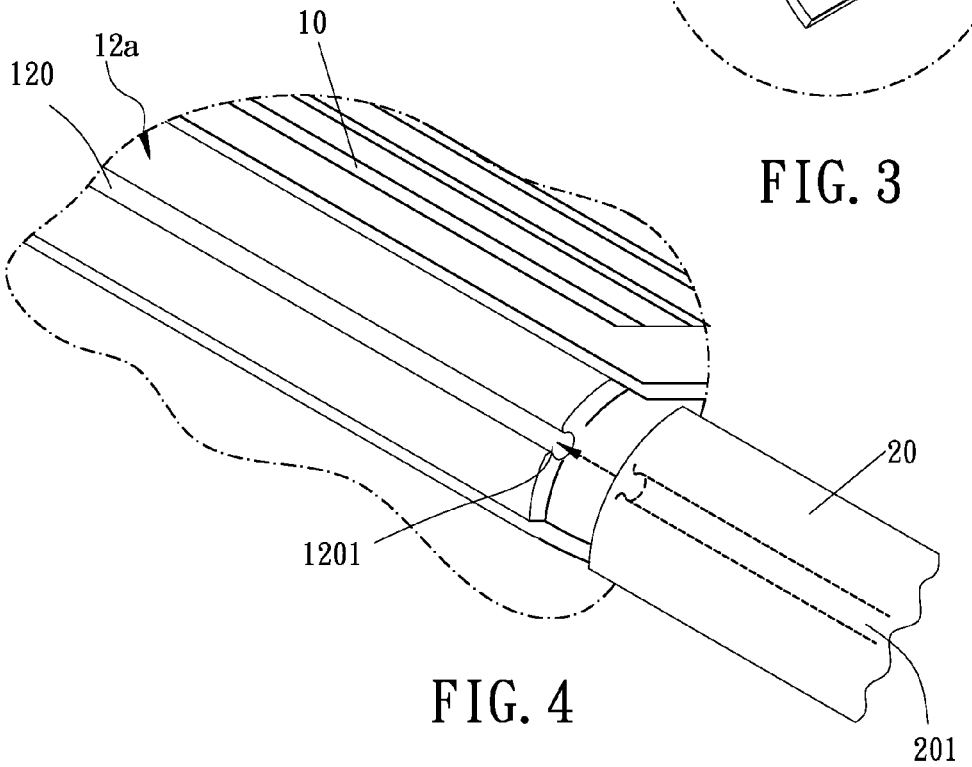
FIGS. 4-5 are partial enlarged perspective views of the assembly of a first connecting section and the edge protector of the reinforced toolbox.

The at least one protection member (2) includes four edge protectors (20) being in a shape to respectively cover the four first connecting sections (12*a*). Each of the four edge protectors (20) has a longitudinal rib (201) extended from one side thereof. The longitudinal rib (201) is in a shape corresponding to the groove (120). Therefore, as shown in FIGS. 3-4, the longitudinal rib (201) is correspondingly inserted into the opening (1201) of the groove (120) and slides into the groove (120) for being engaged with the groove (120), wherein the four edge protectors (20) are respectively engaged with the four first connecting sections (12*a*) for reinforcing the four edges of the toolbox (1).

Figure 5:
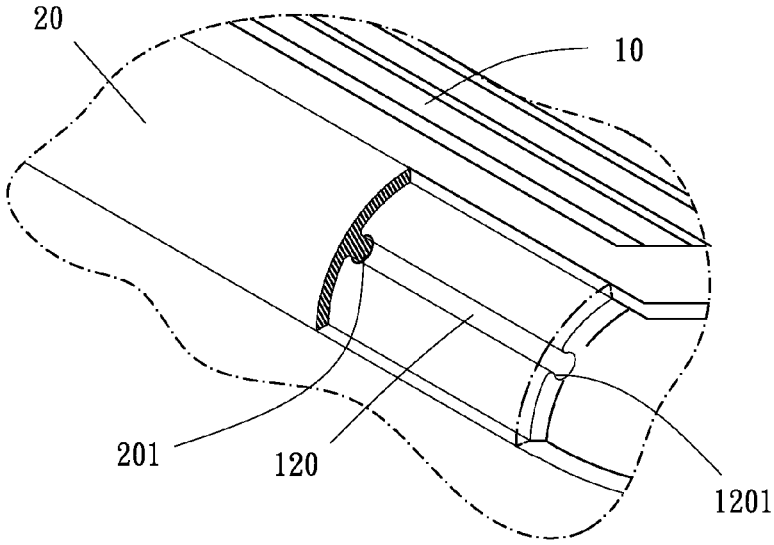
Figure 6:
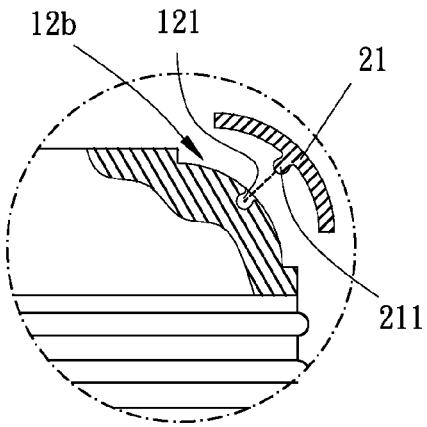
FIGS. 6-7 are enlarged operational plane views of the assembly of a second connecting section and a corner protector of the reinforced toolbox.
Figure 7:
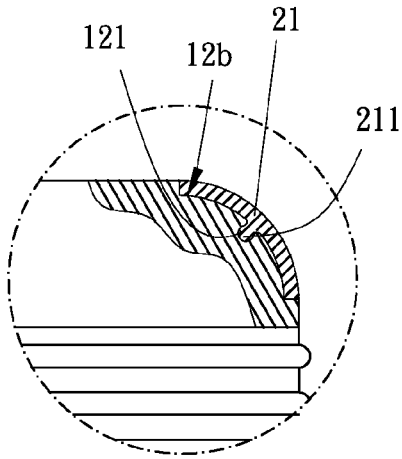

The at least one protection member (2) includes four corner protectors (21) being in a shape to respectively cover the four second connecting portions (12*b*) of the toolbox (1). As shown in FIGS. 5-6, each of the four corner protectors (21) has a first protrusion (211) extended from one side thereof for correspondingly inserting into the hole (121) on each of the four second connecting sections (12*b*), wherein the four corner protectors (21) are respectively engaged with the four second connecting sections (12*b*) for reinforcing the corners of the toolbox (1).

Figure 8:
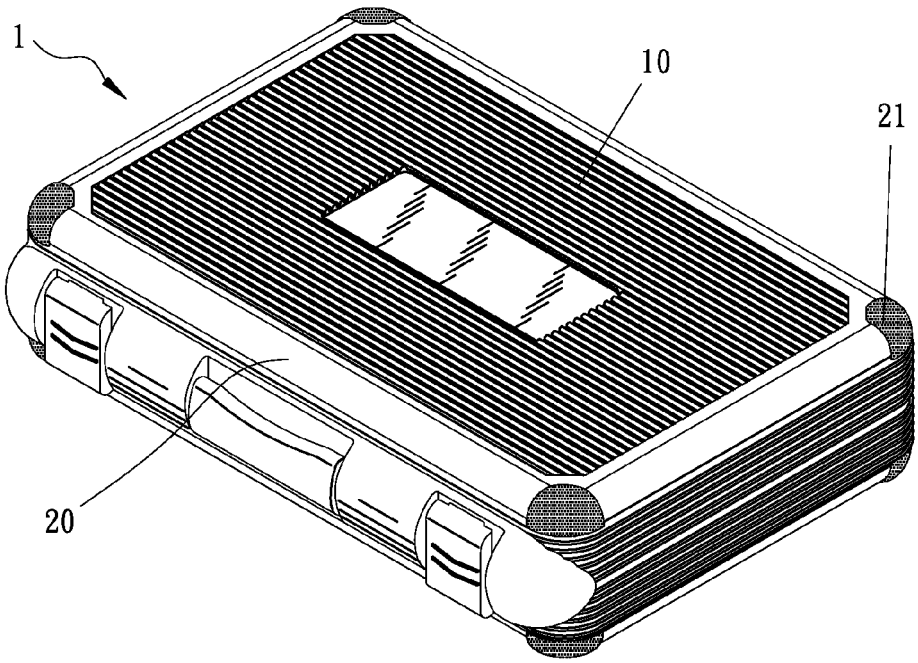
FIG. 8 is an assembled perspective view of the reinforced toolbox.

With reference to FIG. 8, a second embodiment of the toolbox is illustrated. The elements and effects of the second embodiment which are the same with the preferred embodiment are not described, only the differences are described. The at least one connecting section (12) includes a third connecting section (12*c*) disposed on an outer surface (10) of the toolbox (1). The third connecting section (12*c*) has a hollow structure and has four recesses (122) symmetrically defined therein. The at least one protector member (2) includes a panel plate (22) being in a shape to cover the third connecting section (12*c*). The panel plate (22) has one side disposed a decorative pattern or decorative symbols thereon. The other side of the panel plate (22) has four second protrusions (221) extended therefrom, such that the four second protrusions (221) are respectively engaged with the four recesses (122) for decorating and reinforcing the outer top surface (10) of the toolbox (1).

Figure 9:
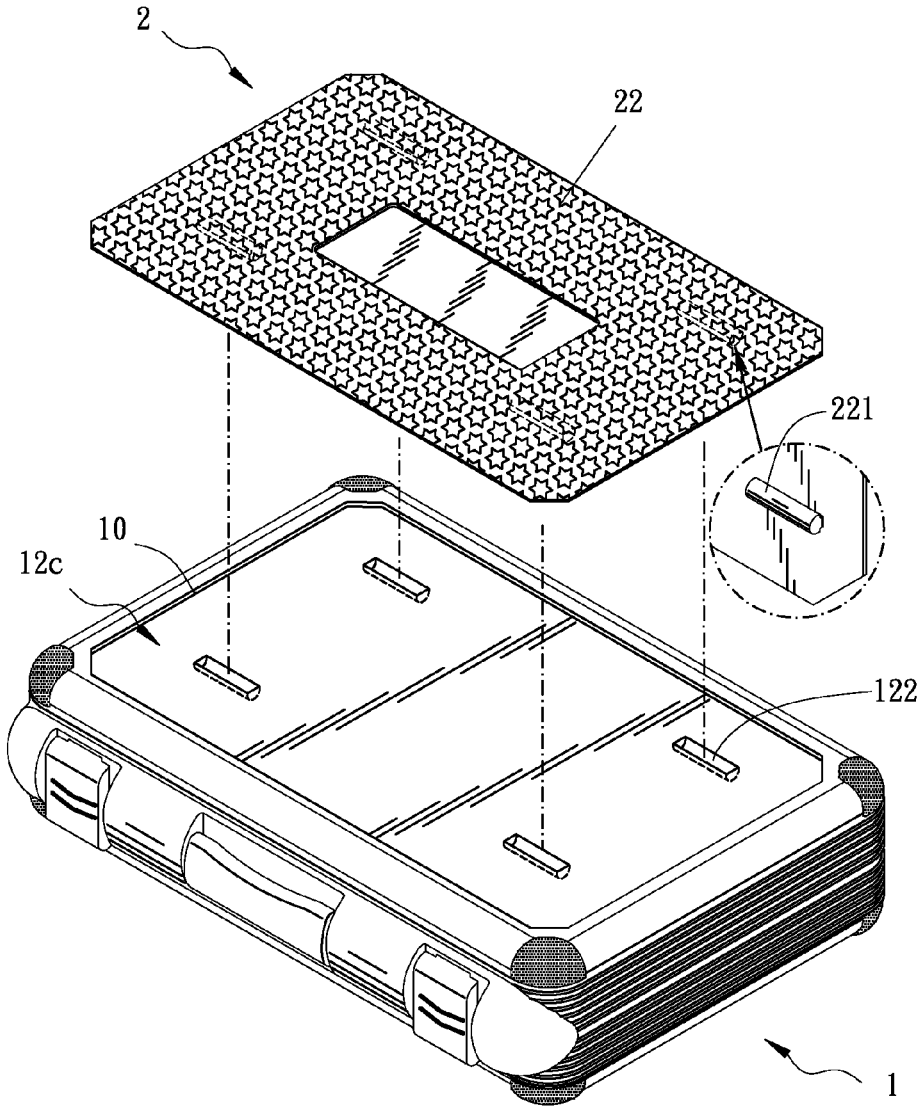
FIG. 9 is an exploded perspective view of a second embodiment of the reinforced toolbox.
Figure 10:
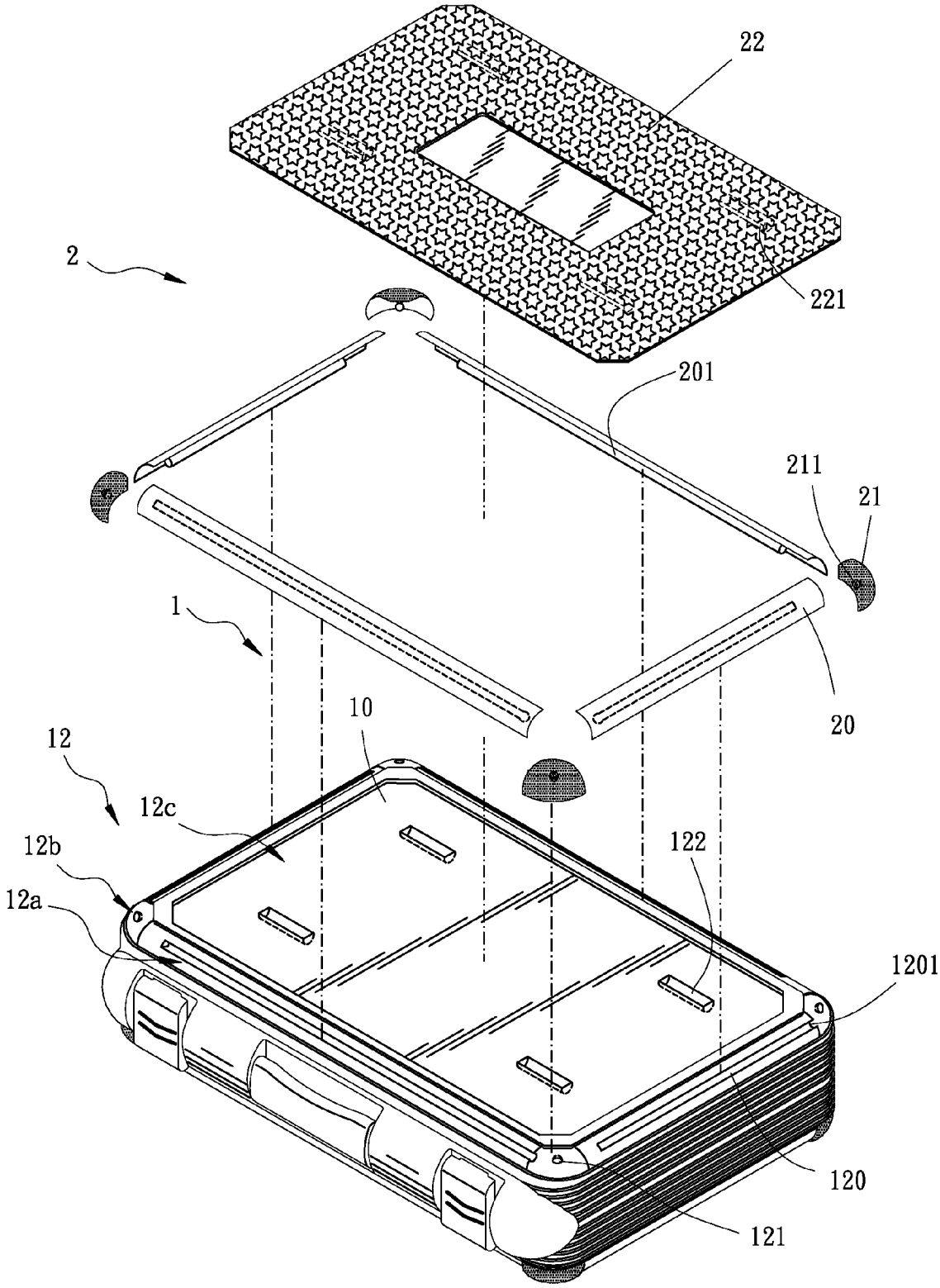
FIG. 10 is an exploded perspective view of a third embodiment of the reinforced toolbox.

With reference to FIG. 9, a third embodiment of the toolbox is illustrated. The elements and effects of the third embodiment which are the same with the preferred embodiment and the second embodiment are not described, only the differences are described. In this embodiment, the at least one connecting section (12) includes four first connecting sections (12*a*) respectively disposed on four edges of an outer surface (10) of the toolbox (1), four second connecting sections (12*b*) respectively disposed on four corners of the outer surface (10) of the toolbox (1), and a third connecting section (12*c*) disposed on the outer surface (10) of the toolbox (1). The at least one protection member (2) includes four edge protectors (20) respectively engaged with the four first connecting section (12*a*), four corner protectors (21) respectively engaged with the four second connecting sections (12*b*), and a panel plate (22) engaged with the third connecting section (12*c*).

Consequently, the at least one protection member (2) is securely engaged with the at least one connecting section (12) to provide for reinforcing, decorating, and protecting the toolbox (1).

Although the invention has been explained in relation to its preferred embodiment, it is to be understood that many other possible modifications and variations can be made without departing from the spirit and scope of the invention as hereinafter claimed.

What is claimed is:

1. A method for forming a reinforced toolbox comprising the steps of:

injection molding step: injection molding a toolbox with plastic material, each edge of the toolbox having a groove formingly defined therein, one end of the groove extending through one end of the edge of the toolbox to form an opening, an inner periphery of the groove being gradually tapered from a bottom thereof to form a dovetail structure;

extruding step: extruding a protector strip with aluminum, the protector strip having a longitudinal rib formed on one side thereof and extending along a length thereof, the longitudinal rib having a shape correspondingly fitting to the groove in the toolbox;

cutting step: cutting the protector strip into a plurality of protectors, each protector having a length corresponding to that of the groove in the toolbox; and assembling step: sliding the longitudinal rib of each protector from the opening into the corresponding groove for protecting the edges of the toolbox such that a reinforced toolbox is manufactured.

2. A method for forming a reinforced toolbox comprising the step of:

injection molding step: injection molding a toolbox with plastic material, each surface of the toolbox having at least one recess formingly defined therein;

extruding step: extruding a prototypical plate with aluminum, the prototypical plate having at least one protrusion formed on one side thereof, each of the at least one protrusion having a shape correspondingly fitting to the recess in the toolbox;

cutting step: cutting the prototypical plate into a plurality of panel plate, each having a size corresponding to that of the surface of the toolbox; and assembling step: pressing the at least one protrusion of the panel plate into the at least one recess of the corresponding surface of the toolbox for protecting the surface of the toolbox such that a reinforced toolbox is manufactured.

* * * * *